United States Patent [19]

Sanford

[11] 4,449,350

[45] May 22, 1984

[54] METHOD AND APPARATUS FOR MAKING SEALED PACKAGES FOR SPREADABLE PRODUCTS

[76] Inventor: Redmond Sanford, 1385 York Ave., New York, N.Y. 10021

[21] Appl. No.: 416,400

[22] Filed: Sep. 9, 1982

Related U.S. Application Data

[63] Continuation of Ser. No. 180,062, Aug. 29, 1980, abandoned, which is a continuation-in-part of Ser. No. 80,141, Sep. 28, 1979, abandoned.

[51] Int. Cl.[3] ..... B65B 47/06; B65B 61/18

[52] U.S. Cl. ..... 53/412; 53/453; 53/456; 53/133; 53/559; 53/579; 493/163; 493/173; 493/250; 426/130

[58] Field of Search ..... 53/412, 450, 456, 453, 53/133, 234, 555, 559, 560, 575, 454, 579; 426/130, 396; 493/250, 163, 172, 173

[56] References Cited

U.S. PATENT DOCUMENTS

| | | | |
|---|---|---|---|
| 1,402,293 | 1/1922 | Heist | 53/560 X |
| 1,481,866 | 1/1924 | Heist | 53/450 |
| 1,654,697 | 1/1928 | Heist | 53/560 X |
| 2,608,405 | 8/1952 | Salfisberg | 53/555 X |
| 2,886,931 | 5/1959 | Karpowicz, Jr. | 53/559 |
| 2,927,409 | 3/1960 | Heyer | 53/559 |
| 2,928,222 | 3/1960 | Lindsaedt | 53/371 X |
| 2,952,105 | 9/1960 | Schur | 53/234 X |
| 3,035,379 | 5/1962 | Croots | 53/234 X |
| 3,054,679 | 9/1962 | Bradford | 53/412 |
| 3,129,546 | 4/1964 | Redmond | 53/122 |
| 3,186,141 | 6/1965 | Zimmerman | 53/559 |
| 3,192,684 | 7/1965 | Iannucci | 53/559 X |
| 3,218,776 | 11/1965 | Croud | 53/453 |
| 3,472,723 | 10/1969 | Lemelson | 53/559 X |
| 3,577,700 | 5/1971 | Bippos | 53/453 |
| 3,805,486 | 4/1974 | Mahaffy et al. | 53/559 |
| 3,844,091 | 10/1974 | Vedvik | 53/555 |
| 3,881,719 | 5/1975 | Schmermund | 53/234 |
| 4,030,662 | 6/1977 | Gess | 426/130 X |
| 4,106,265 | 5/1978 | Aterianus | 53/550 |
| 4,265,070 | 5/1981 | Mainberger | 53/559 |

FOREIGN PATENT DOCUMENTS

| | | | |
|---|---|---|---|
| 683135 | 11/1952 | United Kingdom | 53/559 |

*Primary Examiner*—John Sipos

*Attorney, Agent, or Firm*—Morgan, Finnegan, Pine, Foley & Lee

[57] ABSTRACT

Apparatus and method for making sealed packages for spreadable products includes means for transporting a relatively stiff base member carrying a spreadable product in the approximate center thereof, means for feeding a relatively thin flexible sheet material and for cutting such flexible material into predetermined lengths and for feeding such cut lengths to a rotatable vacuum drum having a plurality of die stations. There is a first tamper which cooperates with the die at the die station as the stations rotate past the tamper to shape each cut length of flexible material into a predetermined three-dimensional form. The three-dimensional form is transported by the vacuum drum to a position over the stiff base and the spreadable product thereon where the formed flexible sheet is released by the vacuum drum and cohesively joined along its outwardly extended edges to the base member to enclose the spreadable product positioned thereon. The longitudinally extending edges of the flexible sheet and base member are further pressed into cohesive engagement by a roller assembly which contains resiliently mounted blades which further compresses the leading and trailing edges into cohesive engagement. A final tamper then tamps the pleats shut. The spreadable product being packaged may also be shaped and sized by the tamper.

The top sheet is attached to the base member so that it can be peeled by the package user from the base member by pulling a peel tab to expose the product.

22 Claims, 22 Drawing Figures

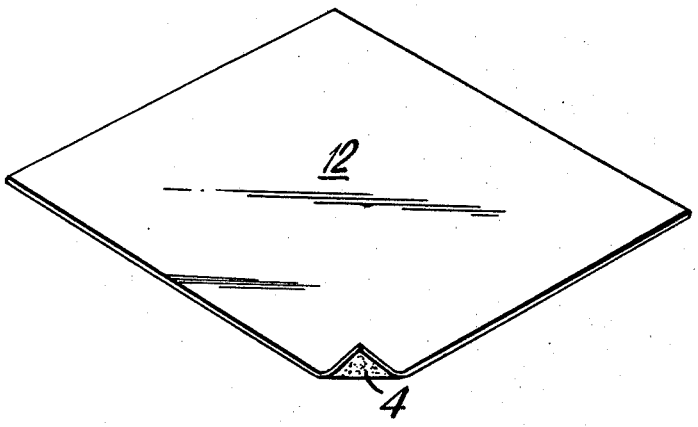
FIG. 1
FIG. 2
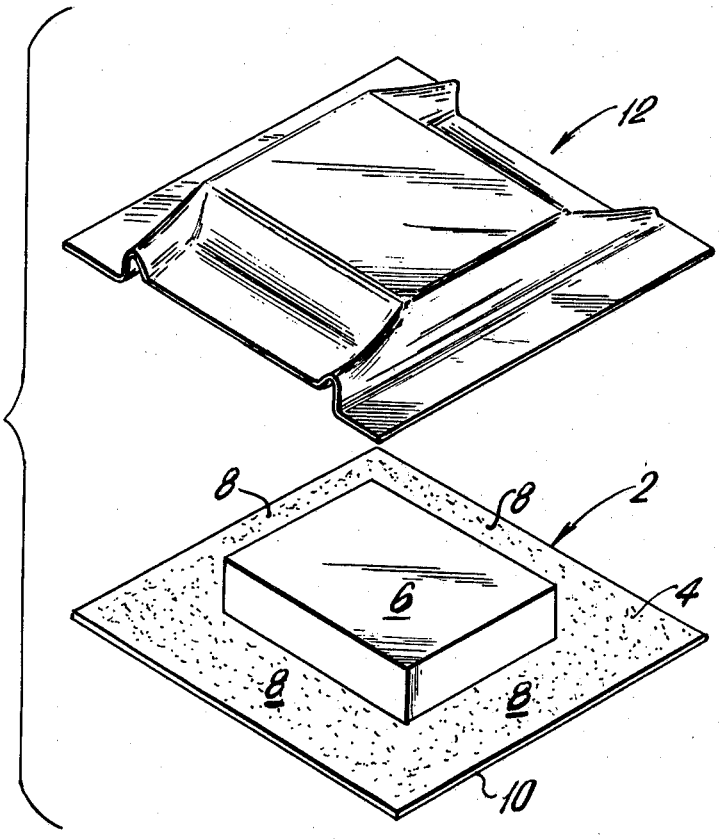

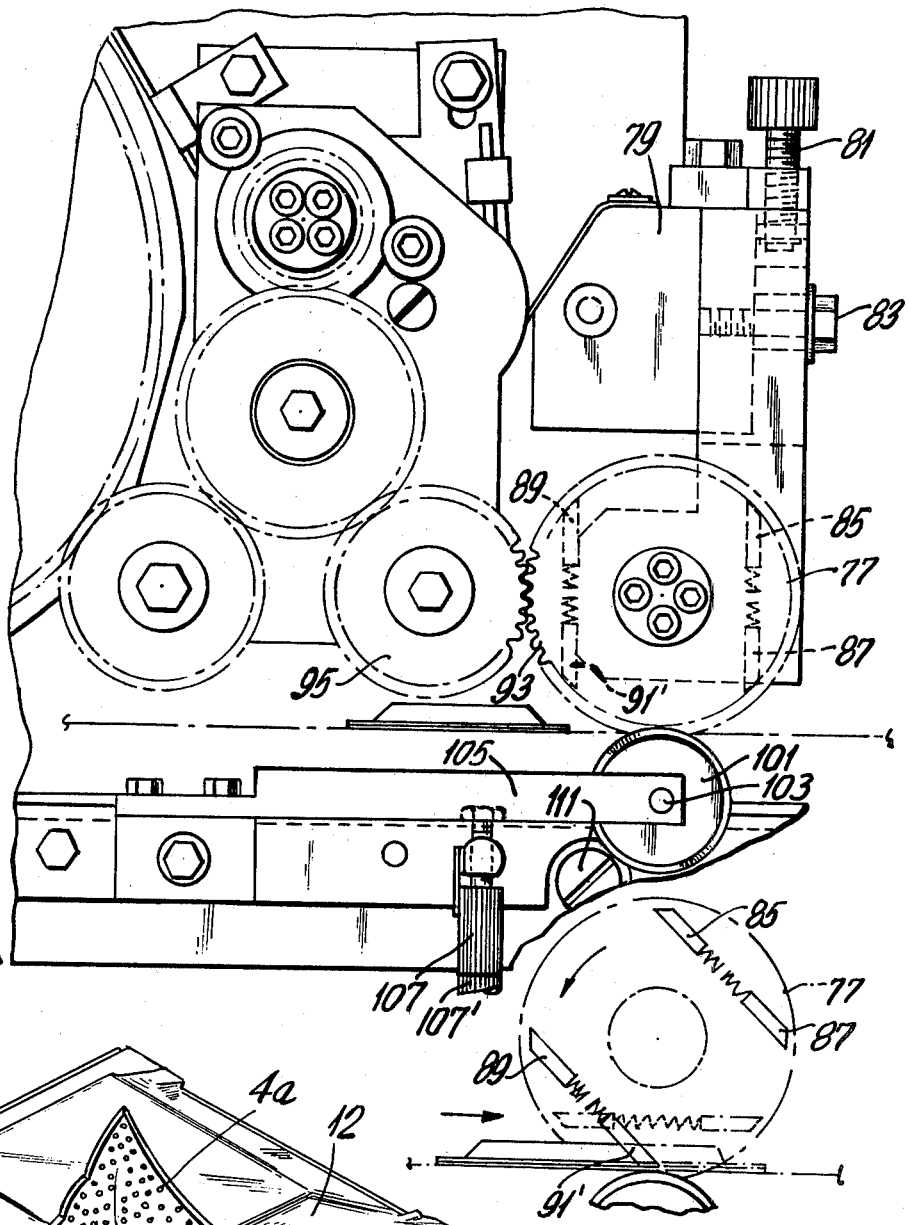
FIG. 8A
FIG. 8B
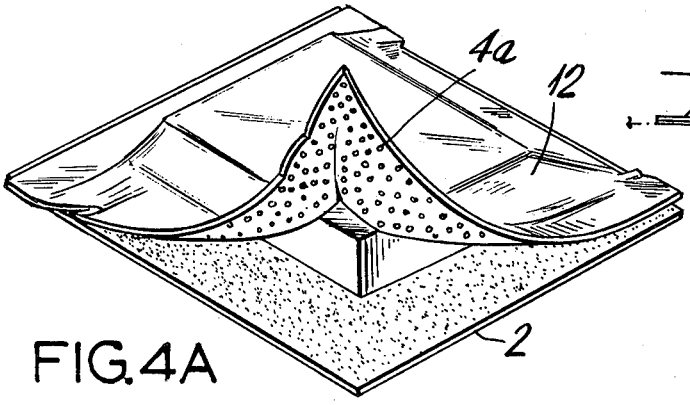
FIG. 4A

METHOD AND APPARATUS FOR MAKING SEALED PACKAGES FOR SPREADABLE PRODUCTS

CROSS-REFERENCE TO RELATED APPLICATION

This is a continuation of application Ser. No. 180,062, filed Aug. 29, 1980, now abandoned which, in turn, is a continuation-in-part of application Ser. No. 080,141, filed Sept. 28, 1979, now abandoned.

BACKGROUND OF THE INVENTION

Application Ser. No. 080,141 relates to sealed packages and more particularly to packages for storing, shipping, handling and for supporting for use, after a three-dimension shaped cover is peeled and removed from such package, a spreadable product adhering to a substantially flat base member of such package and to the method and apparatus for making such sealed packages.

The invention is particularly suited for storing, shipping, handling and supporting for use a food product such as butter, margarine, peanut butter, jelly or other spreadable products desired to be packaged in measured predetermined quantities, such as a pat, and to a method and apparatus for making such sealed packages with such a food product thereon.

At present, spreadable materials, such as butter and margarine, are packaged and are commercially available in a variety of individual service portions. In one package a preformed rectangular shape or pat of butter or margarine is placed on a base card and a flat piece of paper is placed over and stuck to the pat. The pat is covered on the top and bottom but not on the sides. The spreadable product is readily removed from the base card by the user in amounts to suit the user's requirements with a knife or spatula after the cover has been peeled off. Such package is extensively used commercially. However, the spreadable material is not fully enclosed in the package nor is the package sealed.

In another commercial package, the pat is completely wrapped in foil. This package requires the user to unwrap the foil which invariably results in the user getting some of the spreadable material on his fingers. This is messy and an annoyance. Furthermore, because the wrapping material is quite flexible, it is usually necessary to place the opened package on a flat surface such as a table and to scrape the spreadable material from the paper. The flexible wrapper does not provide a convenient base from which suitable amounts of the material can be removed for use. Moreover, such package requires about ten and one-half square inches of foil. This amount of foil is not only expensive but creates a problem of disposing of the wrap after the pat has been unwrapped. This is awkward, unsightly, and a further annoyance while dining. Furthermore, should the product such as butter or margarine become soft, as often happens, the package becomes unusable. If unopened the soft package can be misshaped and cannot be re-refrigerated for re-use.

Another commercial package used for individual service portions or pats of butter or margarine includes a tab or cuplike member of vacuum formed plastic covered with a flat cover of foil, plastic or other material. The butter or margarine is sealed in the tub. To use the butter or margarine the user must first strip the cover off of the plastic tub. Once the rub or cup has been uncovered, the butter or margarine must be scooped or scraped out of the tub with a knife or the like. This is awkward. The product in the corners of the tub cannot be readily removed and is usually wasted. In addition, the package is expensive.

In addition to the foregoing individual service portion butter and margarine packages and the apparatus for the manufacture thereof, there are in the prior art many different types of packaging machines for packing items between one or more sheets of material such as paperboard, corrugated paperboard, plastic laminates or the like. These materials are formable by vacuum, air pressure, punch pressure, compression and other known forming means.

In certain prior art devices for packaging rigid or non-compressible products, the packages are made from two members of roll stock, corrugated cardboard or the like. The roll stock members are passed through the machine by a variety of means such as conveyors, clamps, rollers, etc. The product to be packaged is positioned between the members of roll stock. The members of roll stock are bent and formed about the product. The product acts as a mandrel. The formed roll stock members are attached to each other either by various types of adhesives or by mechanical means such as rivets or staples. In general, the product being packaged is not only rigid, i.e., non-compressible, but is relatively large in size. Furthermore, the package is not used as a support for use of the packaged product nor can such a package be formed about a non-rigid spreadable product such as butter or margarine.

There is a need for a package for a spreadable product, such as butter, margarine, peanut butter, jelly and the like, in which the spreadable product is fully enclosed within the package but from which the product can be readily removed and spread. Such package must be produced from inexpensive materials and must be capable of being produced at high speed and low cost with the product packaged therein. Such package, when opened, should provide a support for the product from which amount of the product might be removed as such amounts are required, such as for spreading on bread, rolls, toast, biscuits, etc. The instant invention provides such a package and an apparatus and method for the production thereof.

OBJECTS OF THE INVENTION

With the foregoing in mind, it is an object of this invention to provide a sealed package for non-rigid spreadable products in which the package is made of inexpensive materials and may be manufactured in large quantities at low cost, is easy to open, and permits the spreadable product contained therein to be readily and fully utilized, even when such product is soft.

Another object of this invention is to provide a sealed package for a spreadable product wherein the product is on a relatively flat and relatively stiff base surface and wherein a relatively thin, flexible cover fully encloses the product and is attached to the base in a manner which permits the cover to be peeled from the base and product and to expose the product for easy use.

Another object of this invention is to provide a sealed package to permit the storing, shipping, handling and supporting for use of a spreadable product wherein the spreadable product is positioned substantially in the center of a relatively stiff base and covered by a relatively flexible cover member which is cohesively joined to the base at least around the base periphery with a peeling tab extending beyond the base so that the flexible cover can be peeled away from the base and product to expose the product.

Another object of this invention is to provide a sealed package for storing, shipping, handling and supporting for use of a spreadable product wherein the product is positioned substantially in the center of a relatively stiff base member having a cohesive coating thereon and a relatively thin, flexible sheet having a cohesive coating thereon is shaped to enclose the spreadable product and cohesively connected to the base around the product to form a three-dimensional cover which can be peeled away from the base and the product to expose the spreadable product on the base for easy use of the exposed product.

Another object is to provide such a sealed package wherein the package is sized and shaped at the final stage of assembly and sealing.

It is still another object of this invention to provide a new and improved method and apparatus for making such sealed packages for storing, shipping, handling and supporting a spreadable product for use.

Another object of this invention is to provide an apparatus for making sealed packages having means for cutting a relatively thin, flexible but not necessarily stretchable top sheet to a predetermined length, means including vacuum means for transporting and securing the cut flexible top sheet while such sheet is shaped into a three-dimensional shape, means for shaping the secured cut sheet into a three-dimensional shape having flange portions and pleats, the vacuum transporting means including means for transferring the formed flexible top sheet to a relatively stiff base member and means for cohering the transferred formed top sheet to the base member.

Additional objects and advantages of the invention will be set forth in the description which follows and, in part, will be obvious from the description, the objects and advantages being realized and obtained by means of the parts, intrumentation, methods, apparatus and procedures particularly pointed out in the appended claims.

BRIEF DESCRIPTION OF THE INVENTION

Briefly described, the invention relates to a sealed package for storing, shipping, handling and supporting a spreadable product. While the sealed package of the invention can be used in connection with many spreadable products, it is particularly suited for pakaging of spreadable products in single service portions such as a pat, from which the user may remove amounts as such amounts are required, for example, butter, margarine, peanut butter, jelly or other spreadable food products. While the product shown herein is generally rectangular, other and different shapes and sizes are contemplated.

The package of the invention includes a base member which is substantially flat and relatively stiff. The base member is resistant to the packaged product or may be coated with a barrier resistant to the product. One side of the base, at least around the marginal edge over the barrier, is coated with a cohesive. The cohesive coating may be continuous or interrupted. A coating of a release material is applied over the opposite side of the base to prevent the cohesive surface from blocking in roll stock form. The product is positioned in the center portion of the base member so that there are cohesive coated margins around the product. The cover member, before it is applied to the base over the product, is preshaped from a relatively thin, flexible sheet of paper or the like dimensioned so that at least at one corner of the base a peeling edge or tab is formed which extends beyond the base edge. In one embodiment, the area of the cover sheet is greater than the base. The sheet is preshaped before it is applied to the base so that it has a center portion having a shape generally similar to the product being packaged and side walls which extend generally downwardly from the center portion towards the base when in the assembled position. The side walls terminate in planar portions which are generally parallel to the base and the center portion. The surface of the flexible cover facing the base, at least in the terminal planar portions, is coated with a cohesive. Preferably, the flexible cover is of a barrier material or is coated with a barrier.

The cohesive coating may be continuous but, preferably, is discontinuous. The planar portions of the cover sheet are interrupted by a plurality of pleats or folds which form projections for peeling the cover sheet from the base and product thereby uncovering the product for use.

After the flexible sheet has been removed, all or selected quantities of the product can be removed from the relatively flat base with a knife, spatula or similar instrument.

Briefly described, another aspect of the invention relates to a method and apparatus for making sealed packages for storing, shipping, handling and supporting for use, when peeled open, for an individual portion of a spreadable product. The invention is particularly suited for use with a mechanism where a serving portion of a spreadable product such as a butter or margarine pat has been placed on a relatively stiff base member, such as coated paperboard, so that there are flanges or margin portions on the stiff base surrounding the spreadable product. There is a supply, such as a roll, of relatively thin flexible material, suuch as paper, which will form the top sheet of the package and means for feeding the top sheet material. The top sheet material is cut into predetermined lengths and transported and shaped into caps. The transporting and shaping means, in the preferred embodiment, includes a rotatable vacuum drum member having a plurality of spaced die stations on its periphery. The cut top sheet is directed to the rotatable vacuum drum and is picked up and held thereon by vacuum in register with a die station. The cut top sheet is rotated to a shaping position where a first tamper contacts the center area of the cut sheet length, pressing the center area of the sheet into the recess in the shaping station and shapes the cut sheet length into a three-dimensional shape, substantially the same shape as the final shape of the cover. The marginal portions of the sheet surrounding the center area forced into the shaping stations recess are held by the vacuum. The shaped top member is transported into register with the stiff base member carrying the spreadable product so that the cohesive coated marginal portions of the shaped cover match the cohesive coated marginal portions of the base member around the product. The leading and trailing marginal portions of the top sheet and base member are pressed together and cohere. At various points the marginal portions of the top sheet are folded into pleats away from the base member. Subsequently an ironing roller presses the side margins together and resiliently mounted blades thereon further press the leading and trailing margins. There is a second tamper which tamps the pleats toward the base member and closes the terminal ends of the pleats and sizes the height of the package. With some packages, the second tamper may also shape as well as size the package.

The instant invention will be better understood from the following description, taken with the appended drawings, of a preferred embodiment of the invention in which FIG. 1 is a perspective view of the top or cover sheet used in the invention;

FIG. 2 is an exploded perspective view of elements of the sealed package before assembly showing the top or cover sheet formed and the product to be packaged on the relatively stiff base;

FIG. 4A is a perspective view similar to FIG. 4 but showing a modified form of the package;

FIG. 8A is a side elevation view of a modified form of the apparatus of FIGS. 7 and 8;

FIG. 8B is a side elevation view of a portion of the apparatus of FIG. 8A but in a different position;

DETAILED DESCRIPTION OF THE INVENTION

Figure 3:
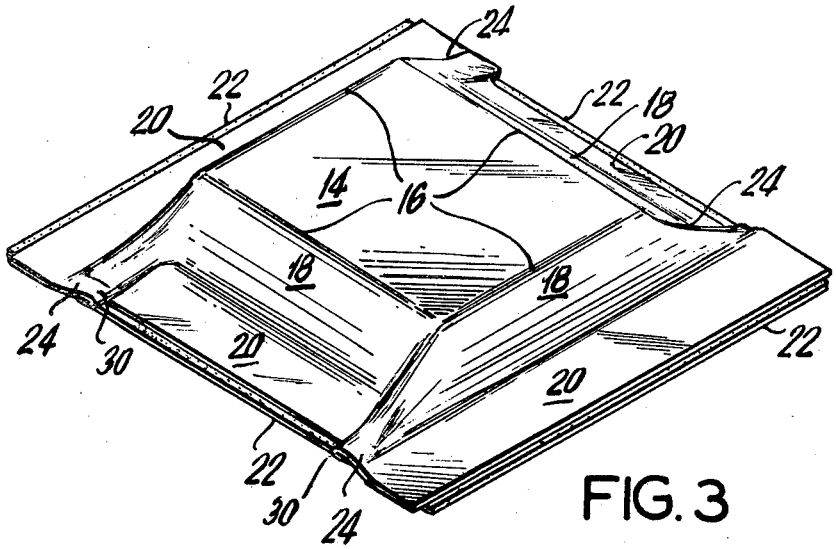
FIG. 3 is a perspective view of the package in sealed condition.

Referring to the drawings, particularly FIGS. 1-6, there is shown a relatively flat, relatively stiff base member, generally designated 2, which, as shown, is rectangular in shape although the invention is not limited to a rectangular shape. Preferably, the base is made of paperboard, or the like, coated with a grease resistant coating and, in one preferred embodiment has a thickness of about ten and one-half (10.5) mils. The base member 2 on its upper surface has a coating of a cohesive material which is cohesive to itself and adhesive to the base at the time of coating but otherwise non-adhesive. The use of a cohesive coating has the advantage that two members so coated can be cohered to each other at extremely high speeds by applying a small amount of pressure and without the necessity of heat. The importance of eleminating heat and heat activated adhesives is that not only must the heat pass through the material on which the adhesive is coated but must then be cooled. Because the rate of speed at which the packages of the instant invention are produced are in the neighborhood of 1500 units per minute in a single line, heat sealing becomes a practical impossibility for the equipment used to manufacture the packages.

As shown, there is positioned in the approximate center of base 2, product 6, such as a pat of spreadable material, e.g., margarine, butter, peanut butter, jelly, or the like. The invention, however, is not limited to spreadable food products and could be used to package artists' paints, salves, ointments, creams, putty or other products which are customarily applied with a knife, spatula or other similar type instrument.

The spreadable product, at normal use temperature, adheres to the base member and will remain adhered to the base member regardless of the orientation of the base member until removed by a knife or spatula.

The product is positioned on the base so as to form margin portions 8 around the product extending to the periphery 10 of the base. The invention further includes a top sheet 12 which is relatively thin, relatively flexible and non-stretchable. The top sheet, in one preferred embodiment, is made of glassine paper having a thickness of about two (2) mils. The top sheet must be flexible and capable of being shaped, as shown in FIG. 2. The top sheet 12 is substantially rectangular and of such dimensions so that peeling tabs, subsequently described, can be formed. The top sheet is also coated, on its under surface facing base 2, with a cohesive 4 such as used on the base. The cohesive 4 must be adhesive to the top sheet at the time of coating and cohesive to cohesive 4 on base 2 but otherwise non-adhesive. When the cover member is peeled from the base and the package product, the cohesive on base and top sheet 12 should part without delamination or peeling of base 2 or top sheet 12. Preferably as best shown in FIG. 4A, cohesive 4 on top sheet 12 is applied in dots 4*a* substantially equal in size and substantially evenly distributed. Cohesive dots of about 0.020 in. diameter, spaced 1/32 in. on centers have been found acceptable. Rather than applying the cohesive in dots to cover 12, the cohesive might be so applied to base 2.

The top member is shaped in some measure in the form of the product being contained, shipped, stored and handled, resulting in a compact, attractive package. This might be accomplished, as later explained, before the top member is applied or might be partially accomplished before the cover is applied with final shaping as the package is completed.

As embodied and shown in FIG. 3, the top member 12 is so shaped as to include a center portion 14 which is relatively flat, rectangular in shape and substantially coextensive with the pat 6 of spreadable material. Extending downwardly from the peripheral edges 16 of the center portion 14 are sides 18. The angle of the sides is not critical and could be at right angles to the center portion 14. The downwardly extending sides 18 terminate the flange or margin portions 20 which extend substantially parallel to center portion 14 and to the peripheral edges 22 of base member 2. It is within the scope of the invention for the flange or margin portion 20 to extend slightly short of, to, or slightly beyond the peripheral edges 22 of base member 2. The flange or marginal portions of the top sheet are in face-in-face contact with the marginal portions of the base, FIGS. 3 and 4. Because these surfaces are cohesive coated, top member 12 and base 2 are cohesively joined around pat 6.

In accordance with this invention means are provided for forming flaps or tabs on the top member which flaps or tabs are used to separate the top sheet from the base and product by grasping any one of the flaps or tabs and peeling the top member from the base member and product thereon. As embodied and best shown in FIGS. 5 and 6, such means comprises a plurality of pleats or folds 24 having end portions 26, at least one of which ends extends beyond the edge of the base forming readily accessible means for peeling and removing top cover member 12 from base 2 and pat 6.

As shown in the drawing, there are four pleats or folds 24 each of which begin at a corner of the center portion 14 and terminate a relatively short distance from the adjacent corner of base member 2. One side 28 of each pleat 24 is substantially parallel to the adjacent edges of top sheet 12 and base member 2 and is, in effect, an extension of its connecting side wall 28. Such side 28 extends a short distance beyond the edge of base member 2 forming the accessible peel tab 26.

It is not necessary that pleats or folds 24 be formed adjacent the corners. It is contemplated that such pleats could be formed, along the sides intermediate the corners. However, forming the pleats adjacent the corners as shown in the drawings constitutes the preferred embodiment. The pleats or folds 24 are flattened at their terminal ends 30, FIG. 3, so as to complete the sealing of the package.

Certain advantages flow from the peeling tabs being located adjacent the corners of the base member.

Figure 4:
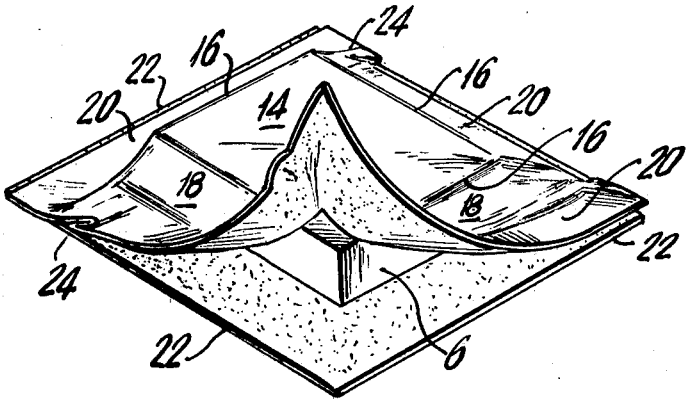
FIG. 4 is a perspective view of the package showing the top sheet being peeled from the base and product.
Figure 5:
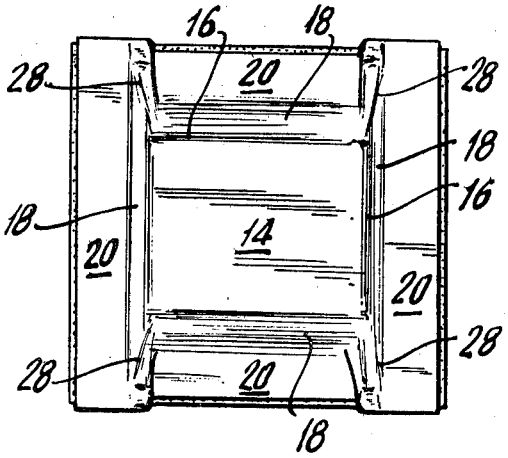
FIG. 5 is a top view of the package of FIG. 3.
Figure 6:
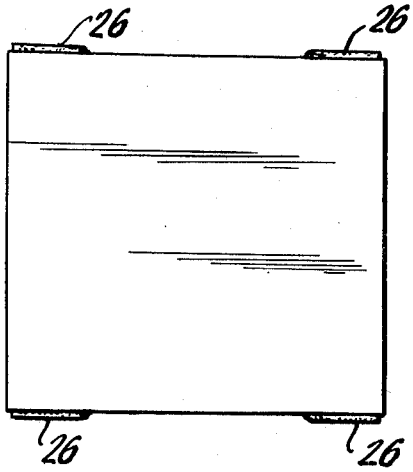
FIG. 6 is a bottom view of the package of FIGS. 3 and 5.

When peeling top member 12 from base member 2, FIG. 4, it is necessary that top member 2 be removed in such a manner that product 6 remains on base member 2. With a spreadable product, such as, margarine, butter, peanut butter and the like, it is obvious that when product 6 remains on relatively stiff flat base member 2 the product can be removed therefrom much more readily, easily and completely than from any cup-shaped member as in previously memtioned types of single portion packages, such as tubs or foil wraps.

Product 6 when in the form of a parallel sides pat, has a relatively large substantially flat surface in engagement and adhering to base member 2. In addition, the peel tabs are positioned and arranged so that cover member 12 when peeled from base member 2 will peel from one corner to the diagonal opposite corner. In this manner, the flexible thin cover peels from pat 6 without peeling far thicker pat 6 from base member 2. Because the surfaces holding the product on the base are larger than the line along which cover member 12 is peeling from base 2 and pat 6, the result is that pat 6 stays in place on base regardless of orientation of the base until pat 6 is wholly or partly removed by a knife, spatula or similar instrument.

The method and apparatus for producing the sealed packages of the instant invention will now be described. Referring to the drawings, particularly FIGS. 7–14, there is shown a stationary frame 32 on which is mounted rotatable roll stock supply member 34 containing a supply of relatively thin flexible top sheet material 36, such as paper, which will be shaped into the top sheet member 12. Conventional brake means 38 engages flexible material 36 to prevent unwanted unwinding of material 36 from stock 34.

Figure 7:
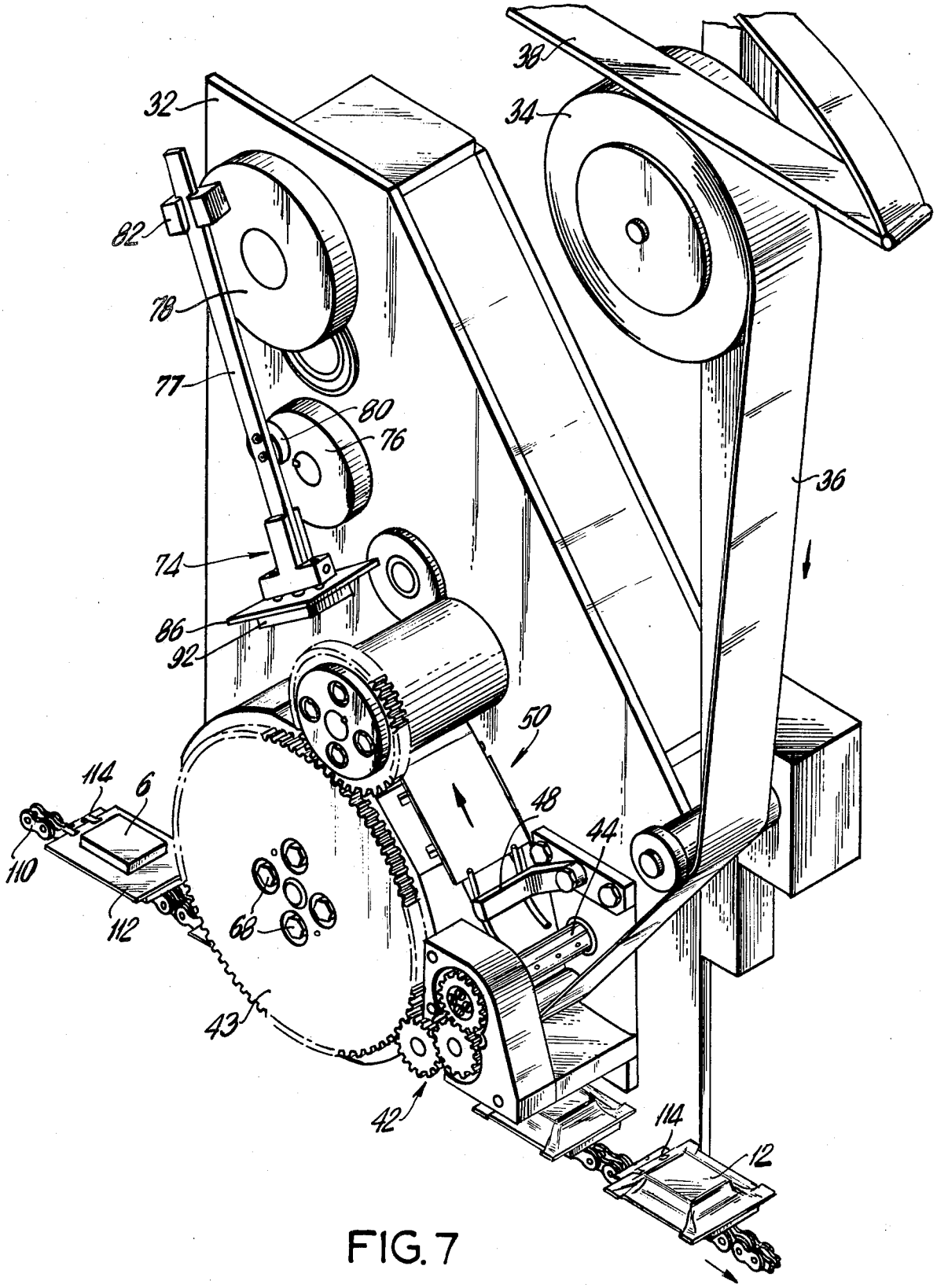
FIG. 7 is a perspective view of the feeding and shaping apparatus of the invention.
Figure 11A:
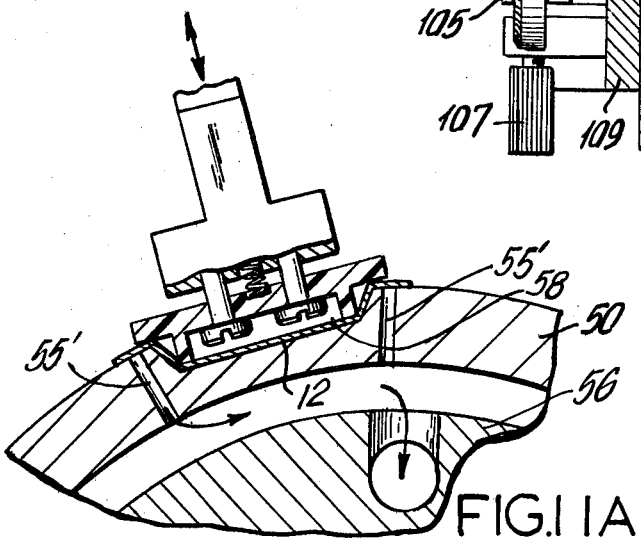
FIG. 11A is a sectional view of a modified portion of the apparatus of FIG. 11.
Figure 11B:
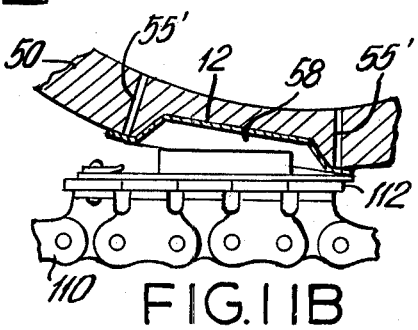
FIG. 11B is a sectional view of the modification of FIG. 11A but taken at a different position.
Figure 11:
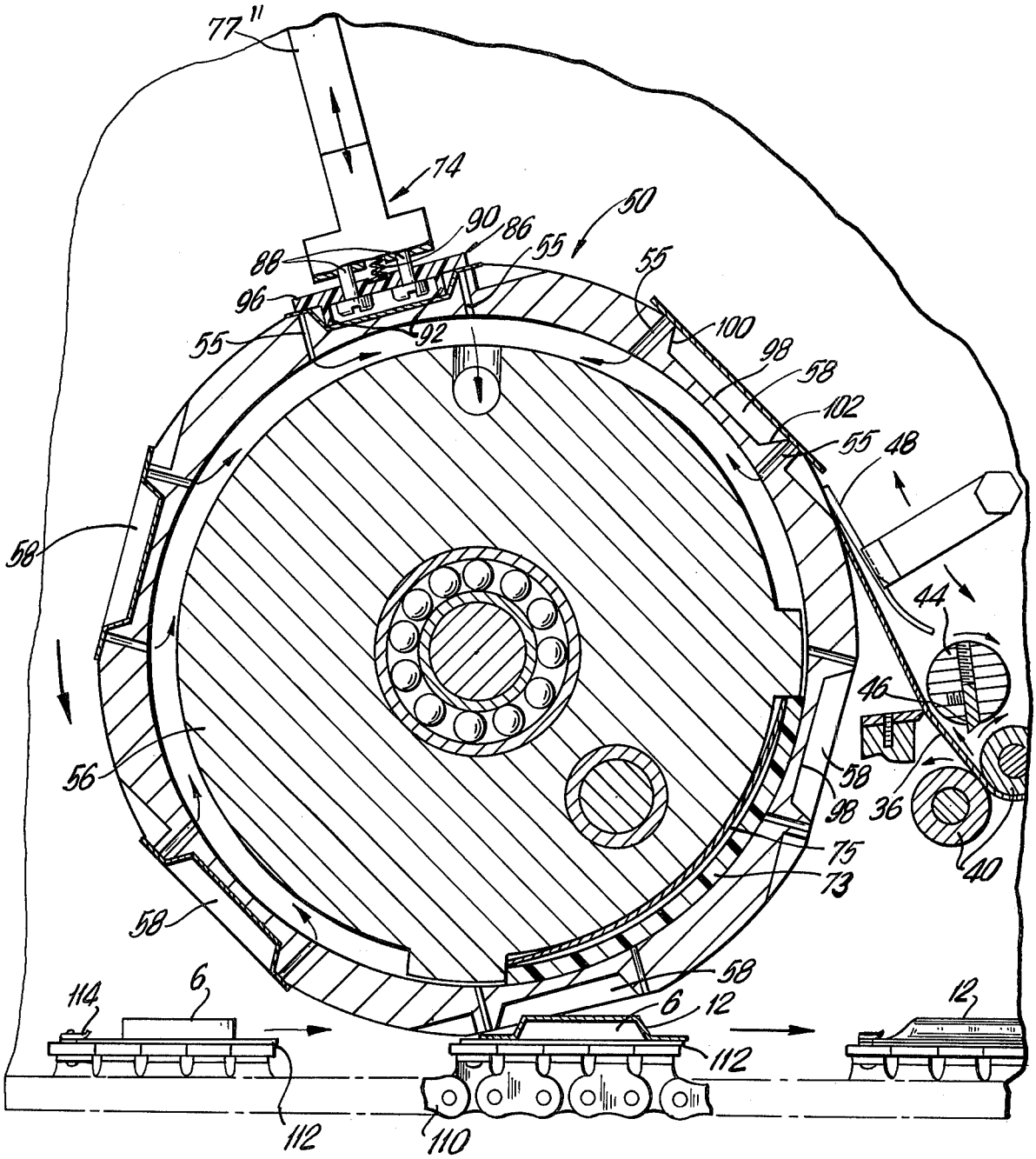
FIG. 11 is a sectional view taken along lines 11—11, FIG. 10.
Figure 12:
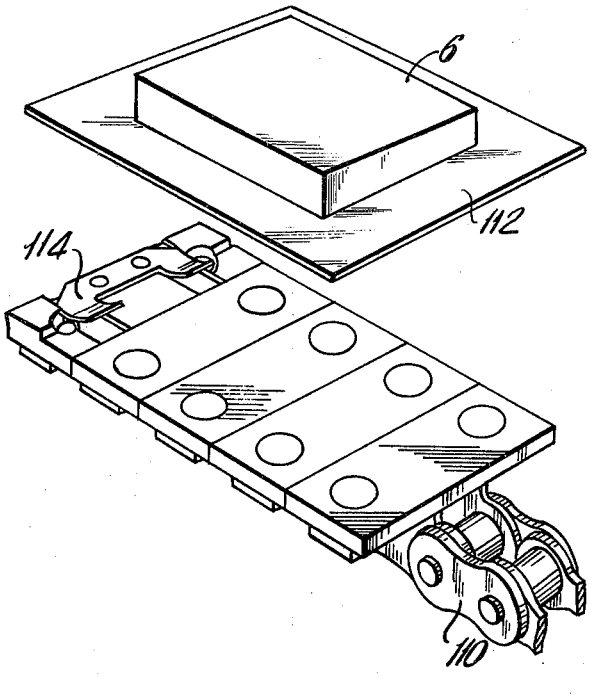
FIG. 12 is an exploded view of a portion of the pat conveyor.

Top sheet material 36 is fed by a pair of feed rollers 40, FIG. 11, driven by gear train 42 and main gear 43, FIG. 7. Gear train 42 also drives roller 44, FIGS. 7 and 11, having knife 46 attached thereto, FIG. 11. Knife 46 cuts top sheet material 36 into predetermined lengths after material 36 passes through feed rollers 40. The cut top sheet 36 is then guided by guides 48, FIG. 7, to vacuum drum means generally designated 50.

Figure 9:
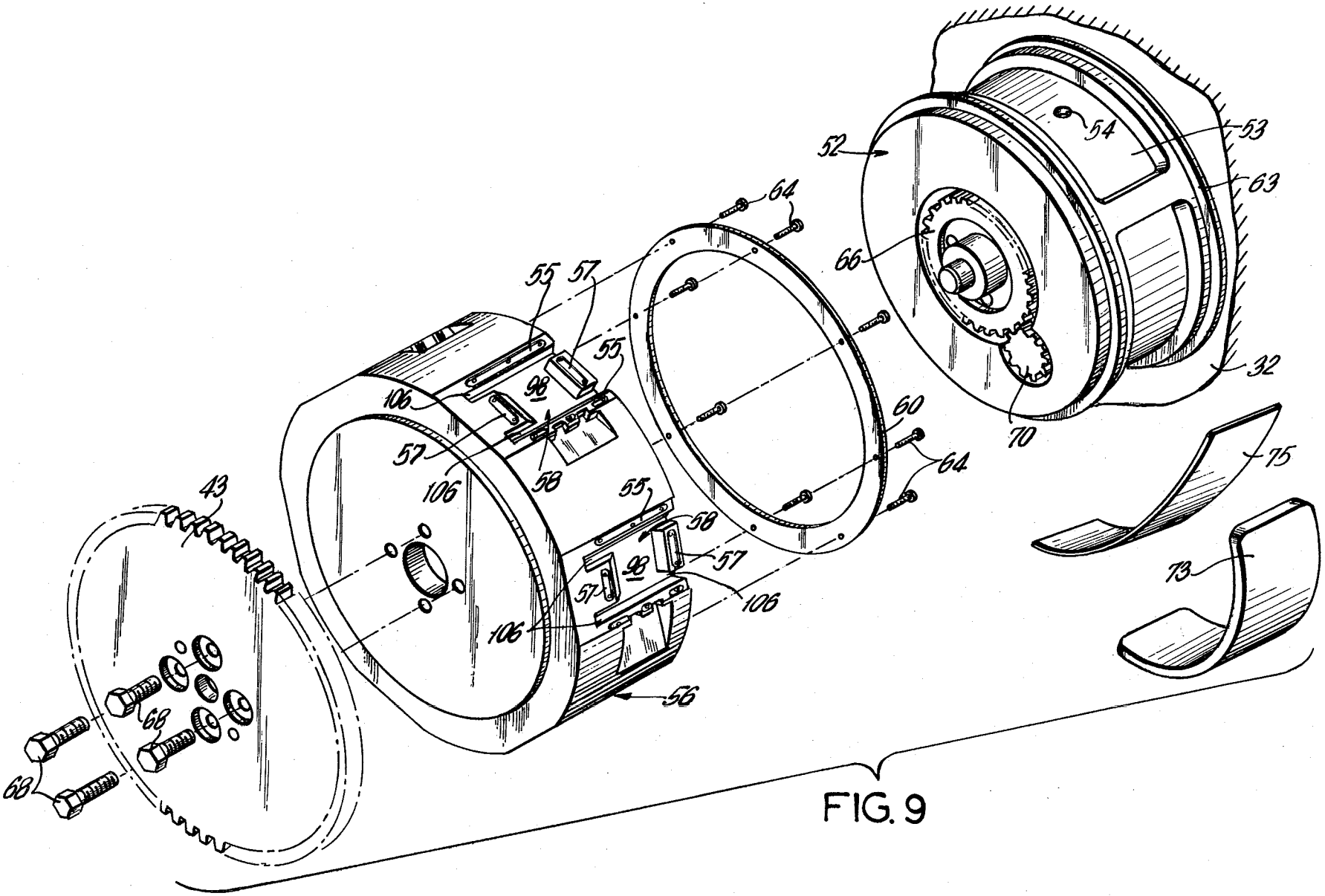
FIG. 9 is an exploded perspective view of the shaping drum of FIGS. 7 and 8.
Figure 10:
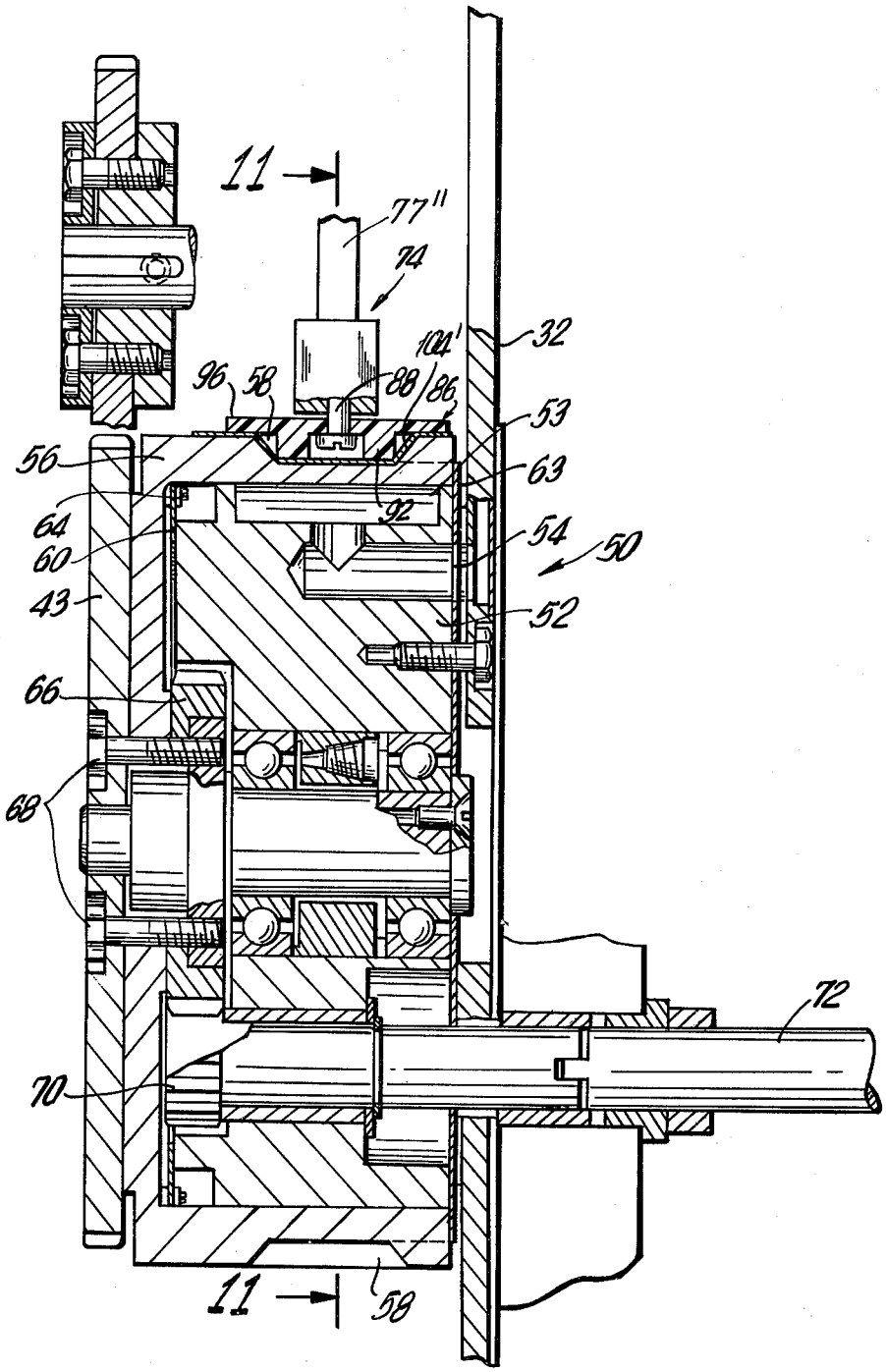
FIG. 10 is a sectional view taken along line 10—10, FIG. 8.

Vacuum drum means 50, FIGS. 9–11, includes a circular manifold 52 fixedly attached to frame 32 in any convenient manner. Through aperture 54 and circular chamber 53 circular manifold 52 communicates with a vacuum source, not shown, for purposes explained subsequently. Through vents 55 and 57, FIGS. 9 and 11, vacuum chamber 53 is vented to the surface of manifold 52 around the periphery of shaping stations 58 for purposes later described. Vents 55, FIG. 11, may be to flats at the leading and trailing ends of shaping station 58 in drum 56 or may be to the arcuate surface of drum adjacent the ends of shaping station 58 as best shown at 55', FIG. 11A.

Mounted in telescoping relationship over manifold 52 and mounted for rotation thereon, is drum 56 having a plurality of die or shaping stations 58 spaced equally about its periphery. While, as shown, there are six such stations there could be a greater or lesser number of such stations depending on the drum size and the drum speed. Connected to the inner surface of the vacuum drum 56 is a sealing ring or gasket 60 attached to drum 56 for rotation therewith by screws 64 or the like. Sealing ring or gasket 63 is mounted in fixed position on manifold 52. Gaskets 60 and 63 form a vacuum tight seal beween stationary manifold 52 and rotating drum 56 for purposes more fully described later herein. Gear 43 is mounted to the outer surface of drum 56 and attached to drum 56 and gear 66, FIGS. 9 and 10, by cap screw 68. Gear 66 is driven by pinion 70 attached to the drive shaft 72. As best shown in FIGS. 9 and 11, sealing shoe 73 is urged by leaf spring 75 into engagement with the inner surface of drum 50 to form a vacuum tight seal therewith for purposes later described.

Figure 8:
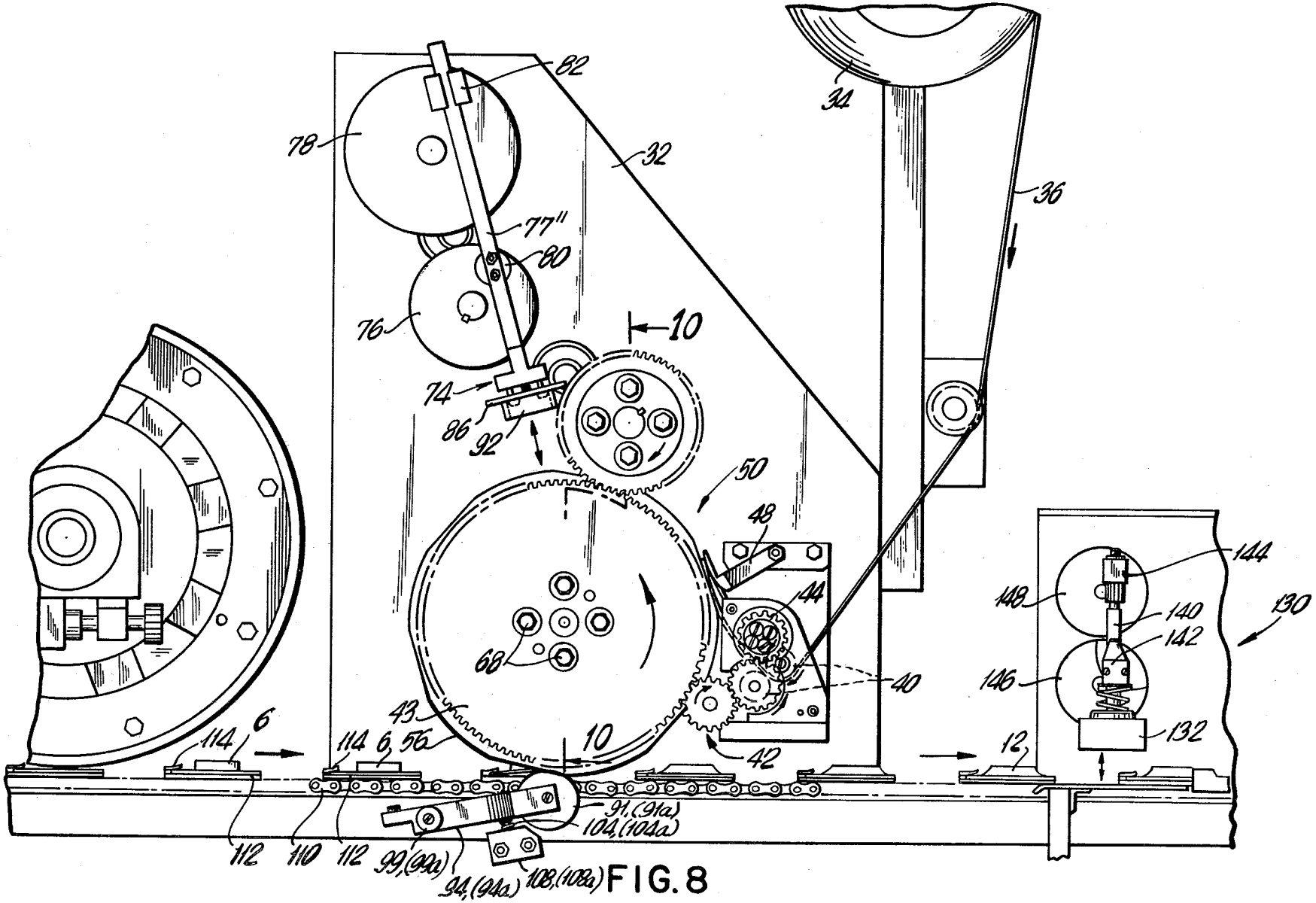
FIG. 8 is a side elevation of the apparatus of FIG. 7.
Figure 8C:
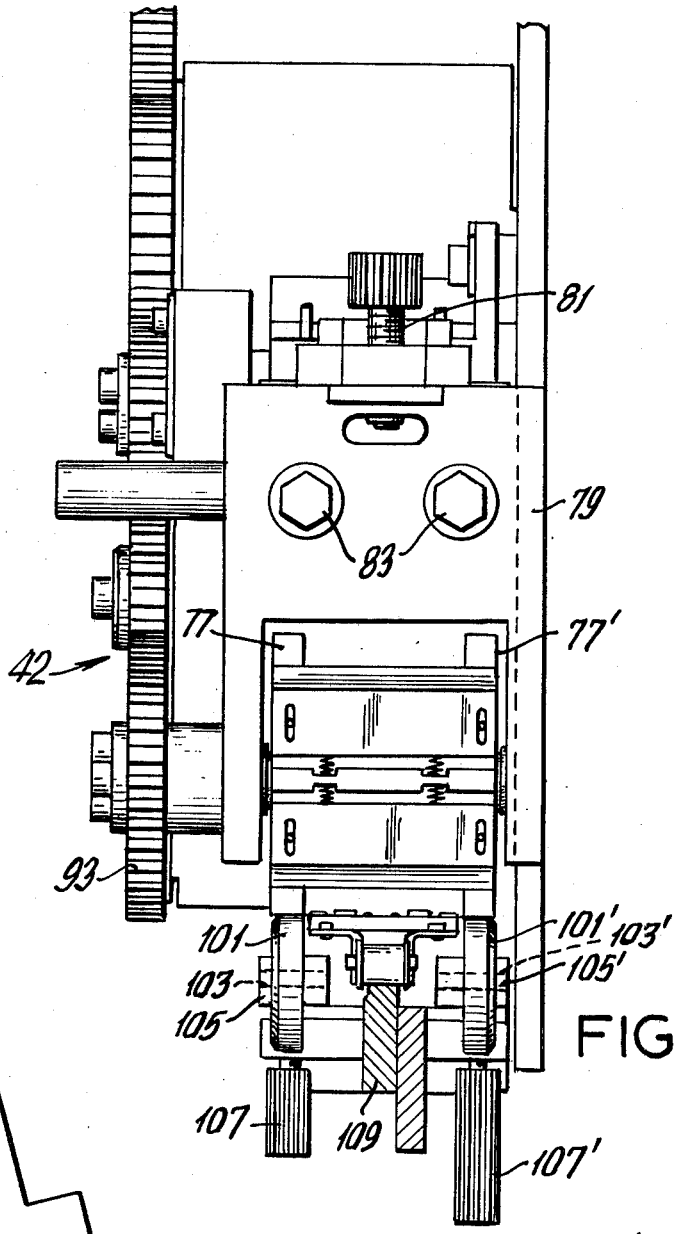
FIG. 8C is an end view of the apparatus of FIG. 8A.

Tamper 74, FIG. 8, is mounted on rod 77" attached by pivot 80 to drive disc 76 and slidably in guide 82 pivotally mounted on guide disc 78. Discs 76, 78 are driven by a conventional gear train, not shown, which in turn is driven from gear 43. The rotation of the discs 76, 78 causes essentially vertical movement of the tamper 74. The terminal end 86 of tamper 74, FIG. 11, is attached by screws 88 and biased by spring 90. Terminal end 86, which preferably is made of a low friction or self-lubricating material, such as nylon, includes a downwardly extending head portion 92 and an outwardly extending flange portion 96.

Each of the shaping stations 58 on vacuum drum 56 includes a flat center portion 98, FIG. 9, inclined leading and trailing walls 100, 102, FIG. 11, and inclined side walls 104, FIG. 10. Spaces or gaps 106 are provided in the surface of drum 56 between the ends of inclined side walls 104' and inclined leading and trailing walls 100, 102 as best seen in FIG. 9.

Referring to FIGS. 8A, 8B drums 77,77' located downstream of drum 56 are mounted for rotation and vertical adjustment on fixed housing 79 by adjustment thumb screw 81 and lock screws 83. Plates 85, 87, 89, 91 are mounted on drums 77, 77' by pins and plate slots and are spring urged outwardly of the periphery of drums 77, 77' by pairs of compression springs mounted in drums 77, 77' at the inner ends of the plates. Drums 77, 77' are driven by gear 93 in turn driven by gear 95 from gear train 42 and in timing therewith. Back up roller 101, 101' are mounted on shaft 103 of pivoted arms 105, 105', pivoted at 107 to the stationary frame. Back up rollers 101, 101', with drums 77, 77', as will be later described, engage the longitudinal edges of base member 2 and cover member 12. Pivot arms 105, 105' and back up rollers 101, 101' are adjusted so that rollers 101, 101' engage the longitudinal edges of the base and cover members with drums 77, 77' by adjustment screws 107, 107'. Carrier 112 is cammed up to engage the leading and trailing edges of base member 2 and cover member 12 with the edges of plates 85,87, 89, 91' by cam 109 adjusted by adjusting screw 111.

The apparatus and sealed package of the instant invention is particularly adapted for use with the apparatus shown and described in U.S. Pat. No. 3,129,546 issued Apr. 21, 1964, the disclosure of which is incorporated herein by reference. The apparatus shown and described in that patent places individual portions of a spreadable product such as butter or margine, on a relatively stiff base member which showing and description is incorporated herein.

As shown and described in more detail in U.S. Pat. No. 3,129,546, pat 6 of butter, margarine, or the like, is formed and deposited on base 2 on conveyor 110 having carriers 112 thereon for receiving and conveying base 2. Each of the carriers 112 has a clip 114 thereon for engaging the trailing end of base member 2 carried thereon and fed by conveyor 110 in the direction of the arrows, FIG. 11.

The pat forming and conveyor 110 driving apparatus of the '546 patent and the apparatus of the instant application are driven from a common drive source, such as an electric motor, not shown, and are geared together so that the carriers 112 and pat 6 therein are each registered with a shaping station 58 on drum 56 as drum 56 rotates in the direction of the arrow, FIG. 11, and conveyor 110 advances carriers 112 and pat 6 past drum 56.

With drum 56 rotating in registry with conveyor 110 and carriers 112 thereon, flexible top sheet material 36 is fed from roll stock 34 through feed rollers 40. The leading end of sheet material 36 is cut by knife 46 into a pre-set length which, as will now be described, is shaped, transferred and adhered to base 2 over pat 6 on carriers 112 as the shaping station 58 carrying the cut and shaped length registers with base 2.

As the pre-set length is cut from the leading end of material 36, the cut sheet is guided by guides 48 into engagement with rotating drum 56. The rotation of drum 56 and the feeding and cutting of material 36 are timed so that guides 48 engage the leading and trailing edges and side edges of the cut sheet over vacuum vents 55, 57. Thus, the vacuum in chamber 53, through vents 55, 57, holds the cut sheet in registry over the center portion 98 and inclined walls 100, 102, 104 of the registered shaping station 58. As each shaping station 58 is rotated in the direction of the arrow, FIG. 11, past guides 48, a preset length of sheet material 36 is fed by rollers 40, cut by knife 46 and deposited on rotating drum 56 in registry with a registered shaping station 58.

As best shown in FIG. 11, the cut length of sheet material 36 extends substantially planar across shaping station 58 and is held thereacross by vents 55, 57 and the vacuum therein.

As each shaping station 58 is rotated in the counterclockwise direction, as shown by the arrow, FIG. 11, under tamper 74, drive disc 76 and guide disc 78, which are continuously driven in synchrony with drum 56, advances terminal end 86 of tamper 74 into engagement with the sheet material. The downwardly extending rectangular head portion 92 of tamper 74 pushes the center portion of the sheet into the shaping station recess toward flat center portion 98. As the center portion of the flat sheet is pushed toward the flat center portion 98 of the shaping station recess, the leading and trailing edges and side edges are forced downward by outwardly extending flanges 96 against vacuum vents 55, 57. Between the leading and trailing edges and side edges, the sheet material is folded into pleats or folds which extend into gaps 106 between the edges. These pleats or folds form the pleats or folds 24 in the sealed package assembly.

Tamper 74 is driven and synchronized to move inward and outward as each shaping station 58 is rotated past the tamper. Thus, as drum 56 rotates past the tamper, tamper 74, which is advancing, forms the sheet material in the die at the shaping station and is withdrawn. The rotary motion of drum 56 and the inward and outward reciprocating motion of tamper 74 is, of course, continuous.

The sheet material, shaped into cover member 12 in shaping station 58 by tamper 74 is rotated downward, in the counterclockwise direction, FIGS. 8 and 11, and as it approaches the six o'clock position, the leading edge of cover 12 engages the leading end of base 2 advancing on conveyor 110. As base 2 is advanced on conveyor 110 toward drum 56 and just before the leading end of base 2 contacts the leading edge of cover 12, the leading end of base 2 contacts and is raised slightly off of carrier 112 by rollers **91, 91*a* at the opposite sides of conveyor 110 and carrier 112. Rollers 91, 91*a*, 92 are spaced so as to clear conveyor 110 and carrier 112 but to contact the longitudinal edge portion of base member 2 and cover member 12** as the base member and cover members are brought together.

Rollers, **91, 91*a*, FIG. 8, are mounted for rotation, respectively, on arms 94, 94*a* pivoted at 99, 99*a* and spring urged, respectively, by springs 104, 104*a* mounted on bases 108, 108*a* in a counterclockwise direction toward the base and cover members longitudinal edges and drum 56. Thus, the longitudinal edges of base member 2 and cover member 12, as such edges are brought together, pass between the surfaces of rollers 91, 91*a* and drum 56. As drum 56 rotates and longitudinal edges of base member 2 and cover member 12 pass therebetween, rollers 91, 91*a* are urged in a clockwise direction, FIG. 8, compressing springs 104, 104*a***.

At about the time the edges of cover 12 are brought into engagement with the edges of base 2 between rollers **91, 91*a* and drum 56, vacuum vents 55, 57 pass beyond vacuum chamber 53, FIG. 11, the vacuum is broken and the cover is released. The cohesive coatings on the contacting surfaces of cover 12 and base 2 brought into contact by the registry of shaping station 58 on rotating drum 56 with base 2 on carrier 112 of conveyor 110 and passing between rollers 91, 91*a* and drum 56 coheres cover 12 to base 2 around product pat 6. From drum 56 and rollers 91, 91*a*, base 2 with cover 12 around pat 6 thereon is advanced to drums 77, 77'. Drums 77, 77' are, of course, rotating and are timed with respect to the advance of conveyor 110, carrier 112 and base 2 so that, as the leading end of base 2 approaches drums 77, 77', the leading end of plate 91' in rotating drums 77, 77' engages the leading end of cover 12. Plate 91' is pushed into the slot against the compression of the springs and the leading edge of cover 12 is cohesively affixed to the leading edge of base 2. As conveyor 110, carrier 112 and base 2 continue to advance and drums 77, 77' continue to rotate, the longitudinal edges of base 2 and cover 12 pass between drums 77, 77' and back up rollers 101, 101'. Drums 77, 77' and rollers 101,101' cohere the longitudinal edges. The leading edge of plate 89 in rotating drums 77, 77' engages the trailing end of cover 12 cohesively affixing the trailing end of the cover to base 2**.

Figure 13:
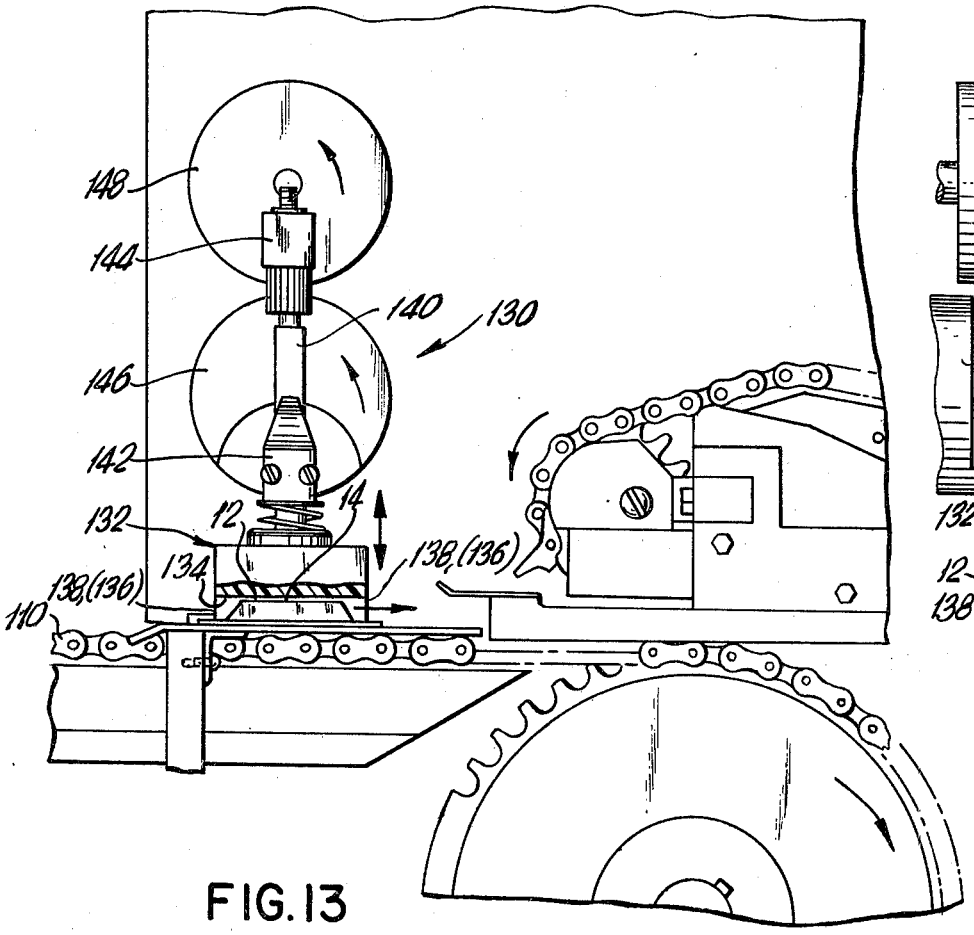
FIG. 13 is an elevation view showing the tamping apparatus.
Figure 14:
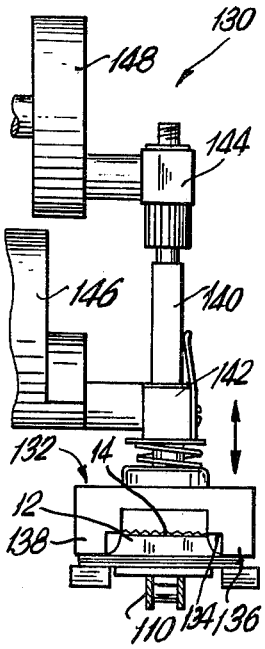
FIG. 14 is a side elevation view of the apparatus of FIG. 13 taken from the left as viewed in FIG. 13.

From rotary drums 56, 77, 77' the covered pat is advanced on carrier 112 by conveyor 110 to a second tamper downstream of drums 56, 77, 77' and generally designed 130, FIGS. 8, 13 and 14. Tamper 130 includes a tamper head 132 of low friction or self-lubricating material, such as nylon, having a raised center portion 134 and downwardly extending side walls 136, 138 extending longitudinally in the direction of travel of conveyor 110 and spaced apart so as to clear pat 6 and raised center portion 14 of the package assembly but, at the same time, close enough to contact the longitudinal flanges of the package. Tamper 130 is connected by tamper rod 140 and pivots 142, 144 to rotating discs 146, 148. Discs 146, 148 are driven continuously by gearing, not shown, from the drive of drum 56 and conveyor 110 and are synchronized therewith. As a cover package from drums 56, 77 approaches tamper 130, tamper head 132 is advancing downwardly. As the covered package moves under and passes tamper 130, downwardly moving side walls 136, 138 of tamper 130 engage the upstanding pleats or folds 24 in cover sheet 12 to collapse and seal the folds, sealing cover 12 on base 2 forming a sealed enclosure about the product pat 6 therein. As conveyor 110 advances the sealed package away from tamper 130, tamper head 132 is elevated by rotating discs 146, 148.

Figure 15:
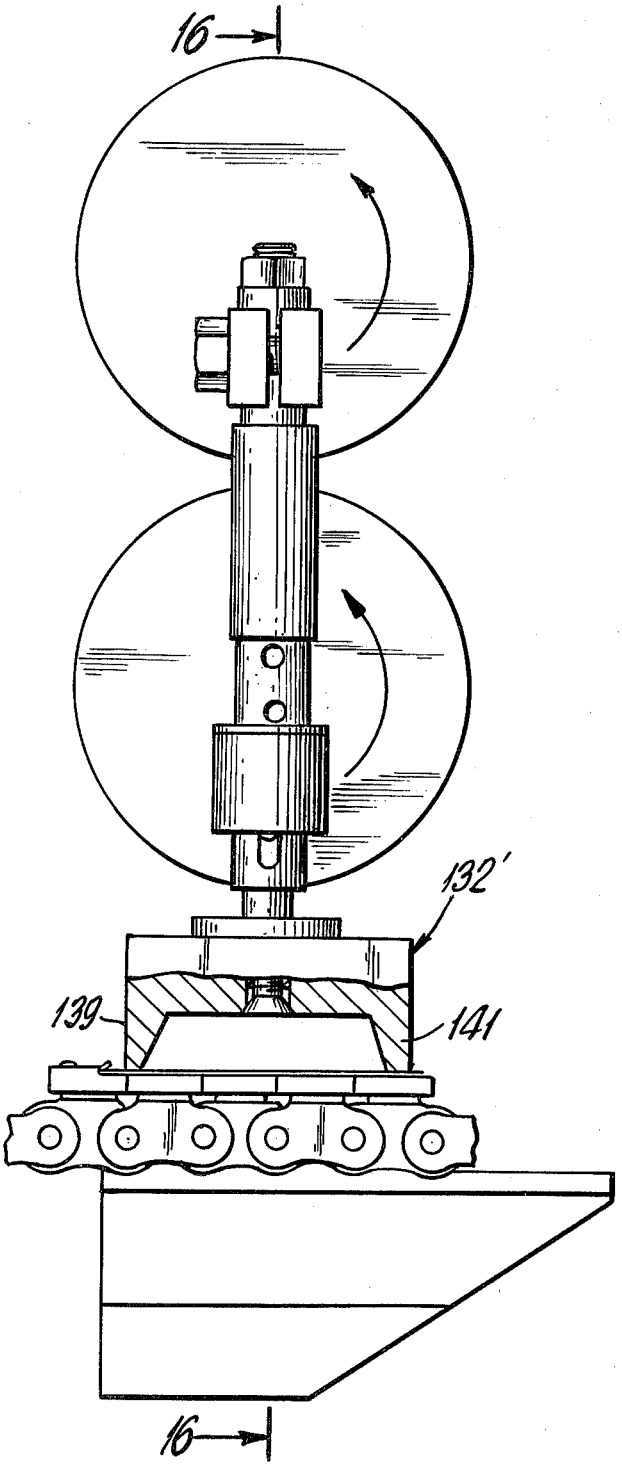
FIG. 15 is a modified form of the apparatus of FIG. 13.
Figure 16:
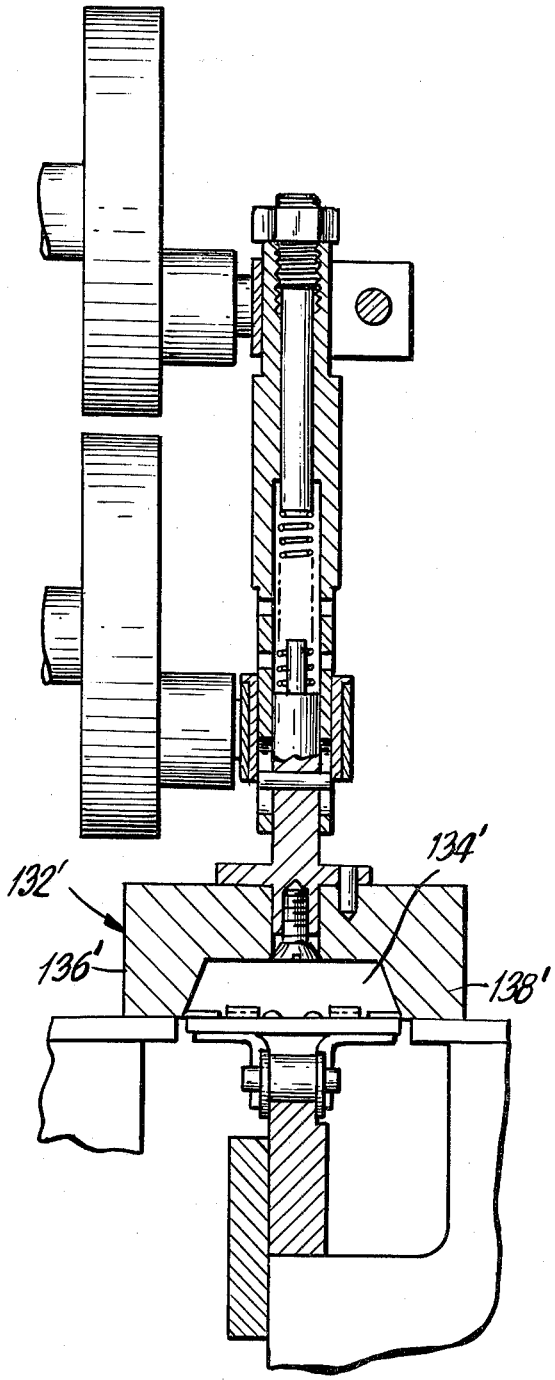
FIG. 16 is a sectional view taken at 16—16, FIG. 15.

In the embodiment of FIGS. 8, 13 and 14, the edges and pleats or folds 24 in cover sheet 12 are sealed on base 2 around product pat 6 thereon. Thus, raised center portion 134 is raised and remains above and spaced from the top of the pat when the pat is tampered. In some instances, especially in larger pats, for example four ounce pats, shaping and sizing of the pat during final tampering might be desired. To accomplish such sizing and shaping tamper head 132', FIGS. 15, 16 has a raised center cavity 134' surrounded by downwardly extending side walls 136', 138' and end walls 139', 141. Center cavity 134' and walls 136', 138', 139',141 are shaped so that, as the ends of walls 136', 138', 139', 141 are brought into engagement with the outwardly extending edges of cover 12 on base 2 around product pat 6, cover 12 engages the dome of cavity 134' and the walls to size and shape the pat. In such instances, of course, the product initially formed and deposited on base 2 is of a volume commensurate with the size and shape to be eventually formed at tamper head 132'.

The sealed packages advanced from tamper 130 may be carried out by hand or by machine such as the counter, stacker and packager in U.S. Pat. No. 3,631,652.

There are numerous cohesive coatings which might be employed in the practice of the instant invention to cohere cover member 12 to base 2. In selecting a cohesive material, a material which is compatible to the materials of the cover and the base, will form strong adhesive bonds therewith and is acceptable for use with the food being packaged should be selected. Preferably, the cohesive material should be cohesive to itself but not to other materials and should be dry to the touch. When cohered to itself, such as between cover member 12 and base 2, the materials should be firm and hold the members together. However, when cover member 12 is peeled from base 2 and pat product 6 packaged therein, such cohesive coatings should part without tearing of the cover sheet or delaminating base 2. The cohesive should, of course, adhere to the surface of the base and cover which may be of a grease repelling material or coated with such material. As already noted, it is preferred to apply the cohesive to either the base or cover, and preferably to the cover, as a series of uniform, equally spaced dots. For purposes of storage and handling before formed into the package, the adhesive might be coated with a parting agent which, of course, should not interfere with cohesion when the base and cover are brought together.

The terms and expressions which have been employed are used as terms of description and not of limitation and there is no intention, in the use of such terms and expressions, of excluding any equivalents of the features shown and described or portions thereof, but it is recognized that various modifications are possible within the scope of the invention claimed.

What is claimed:

1. A method for high speed production of a sealed package for storing, shipping and handling an individual service portion of a spreadable product and for supporting said spreadable product for use after opening said package, comprising the steps of:

(a) continuously rotating a drum having a plurality of shaping stations located on the peripheral surface thereof, each of which includes a shaping cavity formed and substantially completely surrounded by a plurality of walls, at uniformly spaced intervals;

(b) continuously feeding a supply of indefinite length, flexible sheet material;

(c) continuously cutting individual predetermined lengths of said sheet material from said supply thereof;

(d) continuously feeding and directing individual predetermined cut lengths of said sheet material to each of said shaping stations at uniformly synchronized time intervals;

(e) synchronizing the movement of said shaping stations with the speed of said feeding and cutting of said sheet material so that each of said individual cut lengths thereof is deposited in centered register over one of said shaping cavities;

(f) applying a suction substantially completely about the perimeter of each of said shaping cavities so as to pick up and slidably hold the margin portions of said individual cut length of sheet material and cause said material to lie in a substantially flat configuration in centered register across said shaping cavity;

(g) bringing mechanical pressure into shaping register with said shaping cavity along a radial line extending through the axis of rotation of said rum and the center of said shaping cavity to force said sheet material into each of said shaping cavities without stretching during continuous movement of said shaping stations and while simultaneously continuing to apply said suction about the perimeter of said shaping cavity and synchronizing the movement of said mechanical pressure with the speed of said shaping station, thereby causing said margin portions of said sheet material to slide longitudinally and transversely inwardly along the plane of the perimeter of said shaping cavity while said center portion thereof is pressed into said shaping cavity to form said sheet material into a three-dimensional cover member having a substantially flat center portion, a substantially flat margin portion extending laterally outwardly from said center portion in a separate plane generally parallel thereto, and side walls connecting said center portion to said margin portion;

(h) removing said mechanical pressure from each of said formed three-dimensional cover members during continuous movement of said shaping stations and while continuing to apply said suction to said margin portion of said cover member, said suction fixedly retaining said cover member at said shaping station in said three-dimensional shape, said mechanical pressure is applied to and removed from each of said shaping cavities along said radial line throughout said shaping step while said drum and said shaping stations constantly rotate;

(i) inverting each of said shaping stations by the continued rotation of said drum to a position where each of said shaping stations is located directly above and in said moving register with one of said moving base members while said cover member is fixedly retained therein so that said center portion of said cover member is positioned above said margin portion thereof;

(j) at a station remote from said plurality of shaping stations, placing an individual service portion of a spreadable product on the approximate center of a substantially flat, relatively stiff base member having margins surrounding said spreadable product;

(k) continuously transporting said base members at uniformly spaced intervals into moving register with each of said inverted cover members fixedly retained at said shaping stations;

(l) releasing each of said inverted cover members from said shaping stations;

(m) compressing the margins of each of said released cover members on to the margins of one of said base members during said moving register therebetween so that said center portion of said cover member encloses said spreadable product carried on said base member; and (n) removably sealably adhering said margin portion of said cover member to said margins on said base member to sealingly enclose said spreadable product therebetween.

2. The method as recited in claim 1, including the step of:

forming at least one folded pleat in said formed cover member which extends to the margin portion thereof, said folded pleat constituting an extension of said cover member which extends beyond an edge of said base member when said cover member is removably sealably adhered thereto to provide a tab for use in grasping and peeling said cover member from said base member.

3. The method as recited in claim 1, wherein said sheet material is non-thermoformable and non-deformable.

4. The method as recited in claim 1, including the step of applying a cohesive adhesive material to the surfaces of at least said margin portion of said cover member and said margins on said base member.

5. The method as recited in claim 1, wherein said center portion of said cover member is substantially coextensive with said spreadable product carried by said base member.

6. The method as recited in claim 2, wherein each of said base members and said shaping cavities are substantially rectangular in shape, and including the steps of:

cutting said sheet material into substantially rectangularly shaped lengths;

forming said center portion of said cover member into a substantially rectangular shape; and forming a plurality of folded pleats in said cover member each of which extends to the margin portion thereof, each of said plurality of folded pleats constituting an extension of said cover member which extends beyond an adjacent corner of said base member when said cover member is removably sealably adhered thereto.

7. The method as recited in claim 3, wherein said sheet material comprises paper.

8. An apparatus for the high speed production of sealed packages for the storing, shipping and handling of individual service portions of a spreadable product which support said spreadable product for use after said packages are opened, said apparatus adapted to operate in continuous uninterrupted synchronized movement with means for positioning said individual service portions of spreadable product on the approximate center of a substantially flat, relatively stiff base member having margins surrounding said spreadable product, comprising:

(a) a continuous supply of indefinite length, flexible sheet material;

(b) a continuously driven rotatably mounted drum having a plurality of shaping stations on the periphery thereof;

(c) means for continuously feeding and consecutively cutting individual predetermined lengths of said sheet material in synchronization with the rotary movement of said drum;

(d) guide means for directing and continuously feeding each individual predetermined cut length of said sheet material to the peripheral surface of said drum in centered register with each of said shaping stations;

(e) each of said shaping stations including a plurality of walls forming and substantially completely surrounding a shaping cavity, and means for creating a vacuum in said walls substantially completely about the perimeter of said shaping cavity, said vacuum means adapted to engage the margin portions of said individual predetermined cut length of said sheet material at said shaping station and slidably retain said cut length of material against said walls substantially completely about the perimeter of said shaping cavity in a substantially flat configuration in centered register over said shaping cavity;

(f) first tamper means including a tamper head to consecutively press each of said slidably retained individual cut lengths of said sheet material into said shaping cavity at each of said shaping stations to press said sheet material into a three-dimensional cover member without stretching of said sheet material and to thereafter withdraw from the formed three-dimensional cover member, said vacuum means retaining said formed cover member in said three-dimensional shape within said shaping cavity upon withdrawal of said tamper head from said shaping cavity;

(g) said three-dimensional cover member having a substantially flat center portion, a substantially flat margin portion extending laterally outwardly from said center portion in a separate plane generally parallel thereto, and side walls connecting said center portion to said margin portion;

(h) means continuously driving said first tamper means in synchronization with the rotary movement of said drum so that the path followed by said tamper head as it travels into and out of said shaping cavity is always maintained along a radial line extending through the axis of rotation of said drum and the center of said shaping cavity and said tamper head is maintained substantially perpendicular to said radial line while forming said sheet material into said three-dimensional cover member, said tamper head consecutively traveling into and out of each of said shaping cavities during constant rotation of said drum;

(i) said vacuum means slidably retains said margin portions of said sheet material on the peripheral surface of said drum while said tamper head presses the remaining portions thereof into said shaping cavity and thereafter holds said margin portion of the formed cover member in a fixed position thereby maintaining the three-dimensional shape of said cover member upon withdrawal of said tamper head from said shaping cavity;

(j) high speed means continuously transporting said base members at uniformly spaced intervals on a path tangentially adjacent the peripheral surface of said drum in synchronization with the rotation of said drum so that each of said consecutively shaped three-dimensional cover members is transported by said drum into moving register with each of said moving base members, said moving register between said cover member and said base member locating said center portion of said cover member over said spreadable product carried by said base member with no substantial deformation of said spreadable product;

(k) means for releasing said cover member from said drum upon being rotated into moving register with said moving base member, said release means comprising means for breaking said vacuum while substantially simultaneously compressing certain of said margin portion of said cover member onto certain of said margins on said base member; and (l) means for removably sealably adhering said margin portion of said released cover member to said margins on said base member upon compression thereto to sealingly enclose said spreadable product therebetween.

9. Apparatus as recited in claim 8, wherein said sheet material is non-thermoformable and non-deformable.

10. Apparatus as recited in claim 8, wherein each of said shaping cavities has wall means located inwardly of said vacuum means and extending inwardly from the peripheral surface of said drum, said cavity wall means includes at least one channel means therein;

said tamper head includes forming means cooperating with said cavity wall means so that as said tamper head travels into shaping register with said shaping cavity said sheet material is pressed between said tamper head forming means and said cavity wall means and is thereby formed into said three-dimensional cover member; and said channel means in said cavity wall means causes at least one folded pleat to be formed in said margin portion of said cover member, said folded pleat constituting an extension of said cover member which extends beyond an edge of said base member when said cover member is in register therewith to provide a tab for use in grasping and peeling said removably sealably adhered cover member from said base member.

11. Apparatus as recited in claim 8, wherein said removably sealably adhering means comprises cohesive adhesive material applied to at least the surfaces of said margin portion of said cover member and said corresponding margins on said base member.

12. Apparatus as recited in claim 8, wherein said center portion of said cover member is substantially coextensive with said spreadable product carried by said base member.

13. Apparatus as recited in claim 8, wherein said sheet material comprises paper.

14. Apparatus as recited in claim 10, wherein each of said shaping cavities includes a substantially flat bottom wall extending substantially perpendicular to a radial line extending through the axis of rotation of said drum and the center of said shaping cavity, and said cavity wall means extend angularly inwardly from the peripheral surface of said drum to said bottom wall of said shaping cavity.

15. Apparatus, as recited in claim 10, which includes second tamper means for compressing and sealing said folded pleat.

16. Apparatus as recited in claim 14, wherein said cutting means forms said individual cut lengths of said sheet material into a generally rectangular shape;

each of said shaping cavities has a generally rectangular configuration such that said wall means includes leading and trailing end walls extending substantially perpendicularly to the direction of rotation of said drum and a pair of opposed connecting side walls extending substantially perpendicularly to said leading and trailing end walls;

said vacuum means includes at least one suction port venting on the peripheral surface of said drum adjacent the outer edges of each of said leading and trailing cavity end walls and said pair of opposed cavity side walls; and said center portion of said cover member is substantially rectangular in shape.

17. An apparatus, as recited in claim 15, in which said second tamper means includes means for sizing and shaping said sealed packages.

18. Apparatus as recited in claim 16, wherein said tamper head includes lateral flange members which engage and press the margin portion of said cover member against the surface of said drum when said tamper head is in shaping register with said shaping cavity.

19. An apparatus, as recited in claim 16, which includes driven pressure roller means for compressing longitudinal margins of said cover and base members to cohere said margins.

20. Apparatus as recited in claim 16, wherein said channel means comprises an open channel provided adjacent the intersection of each of said leading and traling cavity end walls with each of said cavity side walls, each of said open channels extending from the bottom wall of said cavity to said peripheral surface of said drum, whereby said cover member is formed with folded pleats extending outwardly from each corner of said center portion to said margin thereof, so that when said cover member is in register with said base member each of said folded pleats extends beyond an adjacent corner of said base member.

21. An apparatus, as recited in claim 17, in which said sizing and shaping means includes a recessed tamper member for engaging the top of the sealed package and side members for engaging the sides of the sealed package.

22. An apparatus, as recited in claim 16, which includes resilient transverse pressure means mounted on said driven pressure roller means for further compressing both leading and trailing transverse margins of said cover and base members to cohere said margins.

* * * * *

UNITED STATES PATENT AND TRADEMARK OFFICE

CERTIFICATE OF CORRECTION

PATENT NO. : 4,449,350

DATED : May 22, 1984

INVENTOR(S) : Sanford Redmond

It is certified that error appears in the above—identified patent and that said Letters Patent is hereby corrected as shown below:

On the title page, item 76, "Redmond Sanford" should read -- Sanford Redmond --.

In Column 16, Claim 13 should recite dependency from Claim 9.

In Column 17, line 10, "traling" should read -- trailing --.

In Column 18, Claim 22 should recite dependency from Claim 19.

Signed and Sealed this

*Sixteenth* Day of *July 1985*

[SEAL]

*Attest:*

DONALD J. QUIGG

*Attesting Officer* *Acting Commissioner of Patents and Trademarks*